US005644882A

United States Patent [19]

Brown, Jr.

[11] Patent Number: 5,644,882

[45] Date of Patent: Jul. 8, 1997

[54] ROOFING SYSTEM

[76] Inventor: Carlton Brown, Jr., 534 W. Oak Rd., Vineland, N.J. 08360

[21] Appl. No.: 649,085

[22] Filed: May 17, 1996

[51] Int. Cl.[6] ..... E04B 7/00; E04B 1/38

[52] U.S. Cl. ..... 52/462; 52/460; 52/465; 52/409; 52/518

[58] Field of Search ..... 52/460, 461, 462, 52/465, 469, 576, 416, 578, 409, 410, 746.11, 741.4

[56] References Cited

U.S. PATENT DOCUMENTS

| | | | |
|---|---|---|---|
| 821,606 | 5/1906 | Brogan | 52/461 |
| 1,119,946 | 12/1914 | Gedge . | |
| 1,144,265 | 6/1915 | Von Uffel | 52/462 |
| 1,147,502 | 7/1915 | Von Uffel | 52/462 |
| 1,376,751 | 5/1921 | Edwards . | |
| 1,808,286 | 6/1931 | Britton | 52/462 |
| 2,047,655 | 7/1936 | Von Forster | 52/576 X |
| 2,234,799 | 3/1941 | Eason | 52/462 |
| 2,358,733 | 9/1944 | Overly | 52/461 |
| 2,447,065 | 8/1948 | Goodwin | 52/461 |
| 3,327,443 | 6/1967 | Gay et al. | 52/460 |
| 3,603,056 | 9/1971 | Roth | 52/460 |
| 3,984,958 | 10/1976 | Murray | 52/410 X |
| 4,221,096 | 9/1980 | Viertlboeck . | |
| 4,519,172 | 5/1985 | Ristow | 52/465 X |
| 4,718,211 | 1/1988 | Russell et al. | 52/409 |
| 4,833,853 | 5/1989 | Deibele et al. | 52/746.11 X |
| 5,187,911 | 2/1993 | Cotter . | |

*Primary Examiner*—Robert Canfield
*Attorney, Agent, or Firm*—Norman E. Lehrer

[57] ABSTRACT

A roofing system for a substantially flat roof comprises at least one elongated member. The elongated member extends upwardly from the roof structure and has a bottom surface and an upper surface. Side edges from two waterproof flexible panels are positioned adjacent the upper surface of the elongated member. The side edges of the panels are secured to the upper surface of the elongated member by nailing the same thereto. The resulting seam between the two panels is located above the maximum level of water that may build up on the roof structure during heavy rains. A cap in the form of an elongated sheet of aluminum covers the seam between the two panels. The intersection between a flexible panel and a riser pipe or duct is also positioned above the roof level to similarly prevent standing water from entering the same.

5 Claims, 3 Drawing Sheets

ROOFING SYSTEM

BACKGROUND OF THE INVENTION

The present invention relates to roofing systems and, more particularly, to such a system for protecting the seam between two adjacent rubber insulating panels from prolonged exposure to water.

A significant number of commercial buildings are provided with a substantially flat roof. Typically, such roofs include a wooden layer which is covered with a layer of insulating material. Sheets of rubber or the like are positioned on top of the insulating material in order to protect the roof from rain, snow, etc. The sheets of rubber are transported in cylindrical rolls. During installation, the rubber sheets are placed on top of the insulation layer and are unrolled across the same with the edges of adjacent sheets overlapped. The edges are then bonded together using an adhesive or the like. During heavy rains, water often covers the seams formed between adjacent sheets of rubber. The water seeps between the seams, which may have deteriorated from exposure to the elements, where it eventually causes the roof to leak. Accordingly, such a roofing system has a limited life expectancy.

In recognition of the foregoing, a roofing system has been proposed in U.S. Pat. No. 4,221,096 which involves the raising of the seams between adjacent flexible sheets of roofing material above the level of standing water on a substantially flat roof. The raising of the seams is accomplished through the utilization of V-shaped channel members secured to the roof. The sheets of roofing material are secured to the roof in such a manner that the seams are positioned near the top of the channel members and away from any standing water. The securement of the sheets of roofing material to the V-shaped channel members is cumbersome due to the limited surface area at the apex of the channel members.

SUMMARY OF THE INVENTION

The present invention is designed to overcome the deficiencies of the prior art discussed above. It is an object of the invention to provide a roofing system that is easy to install.

It is a further object of the invention to provide such a roofing system that is relatively inexpensive to manufacture.

It is yet another object of the invention to provide a roofing system that is durable.

In accordance with the illustrative embodiments, demonstrating features and advantages of the present invention, there is provided a roofing system for a substantially flat roof structure which comprises at least one elongated member. The elongated member extends upwardly from the roof structure and has a bottom surface and an upper surface. Side edges from two waterproof flexible panels are positioned adjacent the upper surface of the elongated member. The side edges of the panels are secured to the upper surface of the elongated member by nailing the same thereto. The resulting seam between the two panels is located above the maximum level of water that may build up on the roof structure during heavy rains. The intersection between a flexible panel and a riser pipe or duct is also positioned above the roof level to similarly prevent standing water from entering the same.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
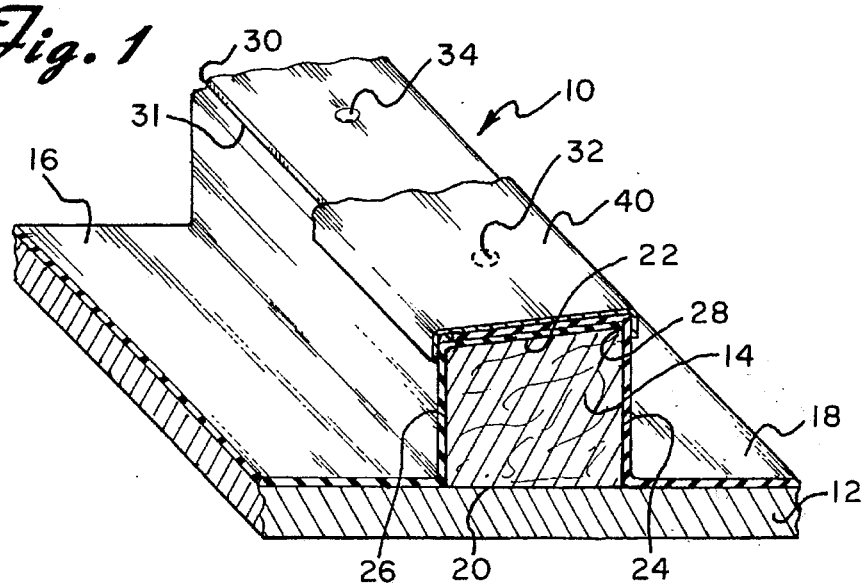
FIG. 1 is a partial perspective view of two insulating panels secured to the upper surface of a nailer positioned on top of a roof.

Referring now to the drawings in detail wherein like reference numerals have been used throughout the various figures to designate like elements, there is shown in FIG. 1 a roofing system constructed in accordance with the principles of the present invention and designated generally as 10. The roofing system is designed for use with a substantially flat roof structure 12. The roof structure 12 is slightly inclined to prevent the build up of standing water from heavy rains.

The roofing system 10 typically includes a plurality of elongated members and panels of flexible waterproof insulating material. FIG. 1 illustrates one elongated member 14 and two panels 16 and 18. The elongated member 14, which is in the form of a wooden nailer, is secured to the roof structure 12, preferably by nailing the same thereto. The elongated member has a bottom surface 20, an upper surface 22 first and second planar side surfaces 24 and 26, respectively. The first planar side surface 24 has a greater height than the second planar side surface 26 (FIG. 1). The upper surface is slanted downwardly from the first planar side surface 24 to the second planar side surface 26. Moreover, the upper surface is located above the maximum water level encountered by the roof structure during heavy rains and the like.

Each of the panels 16 and 18 includes a side edge 28 and 30, respectively, which is positioned adjacent the upper surface 22 of the elongated member 14. The preferred material for the panels is silicone rubber. However, the panels can be comprised of a variety of other waterproof polymeric materials. During installation, the second panel 16 is placed on the upper surface 22 of the elongated member so that the edge 28 is adjacent the side surface 24.

The panel 16 overlies the upper surface 22 and the side surface 26 of the elongated member 14 as illustrated in FIG. 1. First panel 18 overlaps the portion of the panel 16 which covers the upper surface of the elongated member end and overlies the side surface 28 thereof. Edge 30 of panel 18 forms a seam 31 adjacent the upper surface 22 of the elongated member. Since the edges 28 and 30 of each of the panels 16 and 18, respectively, are located adjacent the upper surface 22 of the elongated member, the likelihood of the edges being exposed to standing water, which may build up on the roof structure, is minimized.

Moreover, the only exposed seam 31 is between edge 30 of the panel 18 and the panel 16. Since the upper surface of the elongated member is slightly slanted, rain water which may encounter the seam will be directed away from the same. This further ensures that standing water will not able to make its way between the two panels and onto the roof structure 12.

Nails 32 and 34 are preferably utilized to secure the panels 16 and 18 to one another and to the elongated member 14. However, the panels can be secured to each other and to the elongated member in a number of different ways such as through the use of an adhesive. In the preferred embodiment, a cap 40 is secured over the upper surface 22 of the elongated member 14. The cap is preferably composed of aluminum sheet and prevents any water from accumulating in gaps formed around the nails or in the seam 31 which could potentially result in the deterioration of the panels 16 and 18. Instead of securing the panels 16 and 18 directly to the roof structure 12, it should be noted that a layer of insulating material (not shown) could first be applied over the roof structure 12.

Figure 2:
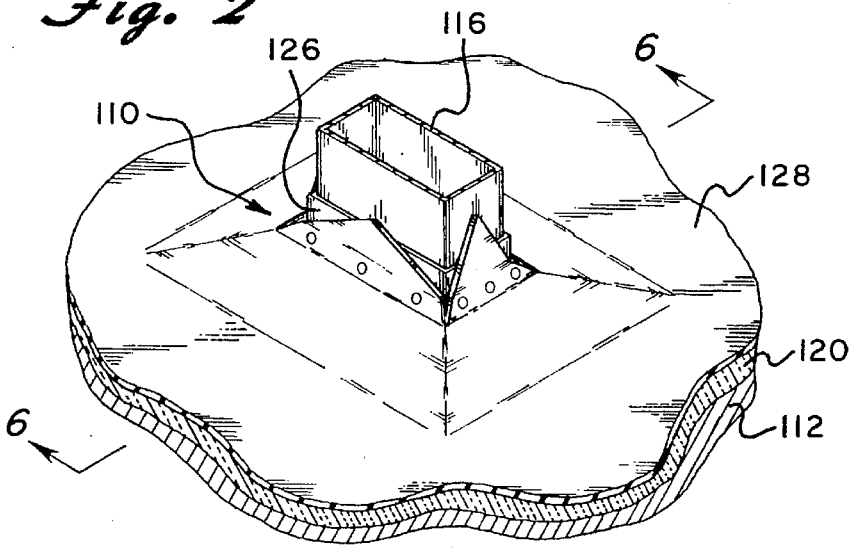
FIG. 2 is a perspective view of a rubber insulating panel shown covering a roof structure and located around a section of metal flashing.
Figure 6:
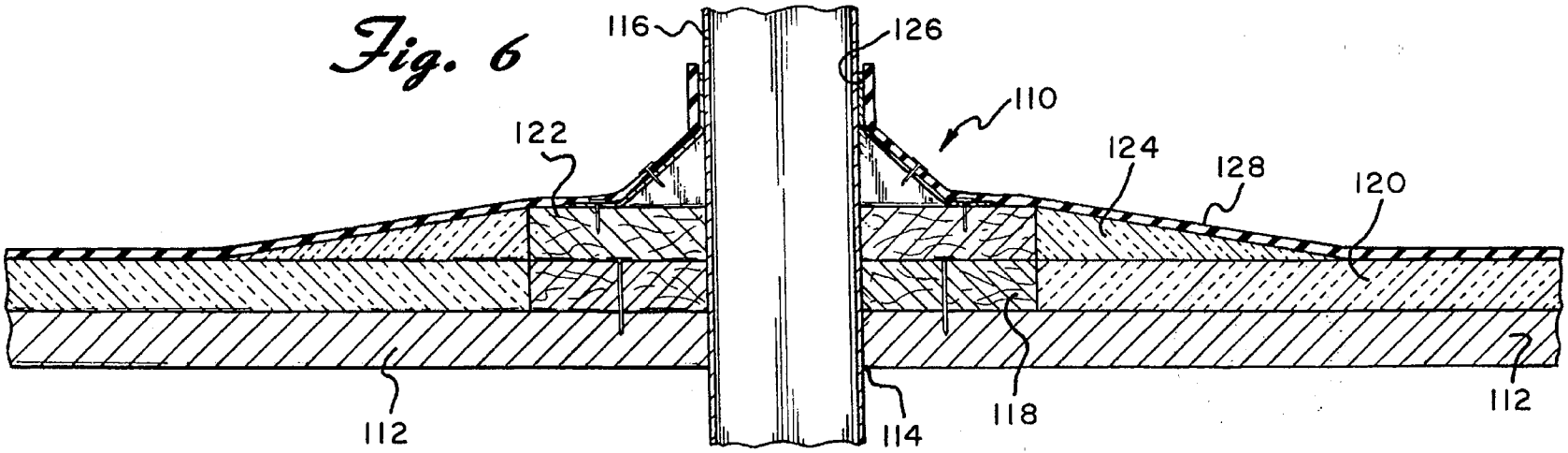
FIG. 6 is a cross-sectional view taken along lines 6—6 of FIG. 2.
Figure 7:
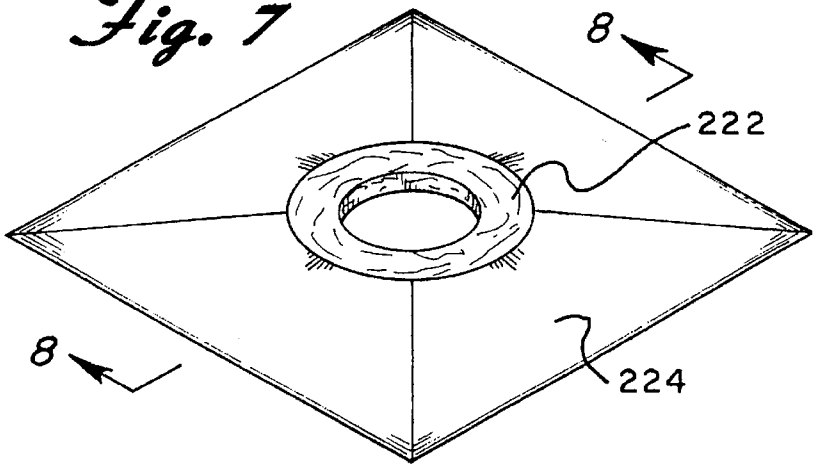
FIG. 7 is a perspective view of a cylindrically shaped raised member with tapered insulation secured around the outer periphery thereof.
Figure 8:
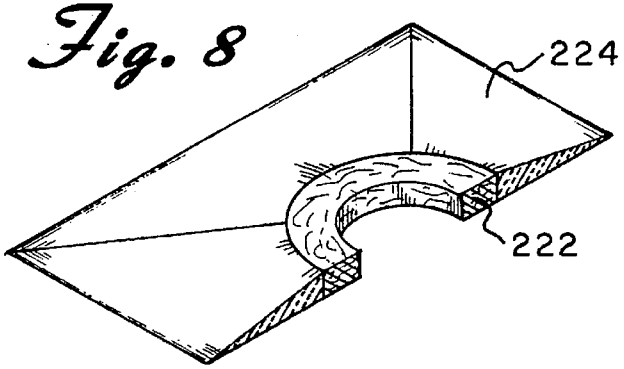
FIG. 8 is a cross-sectional view taken along lines 8—8 of FIG. 7.

In the embodiment shown in FIGS. 2 and 6, an alternate roofing system 110 for a substantially flat roof structure 112 is shown. The roof structure has an opening 114 formed therethrough in order to allow a conventional HVAC unit 116 or the like to pass. The opening is designed to match the size and shape of the particular HVAC unit.

Positioned around the opening 114 is a lower raised member 118 which is preferably secured to the roof structure by nailing the same thereto (FIG. 6). A layer of insulation 120 is preferably placed around the outer perimeter of the lower raised member. The insulation layer covers the roof structure 112.

Figure 5:
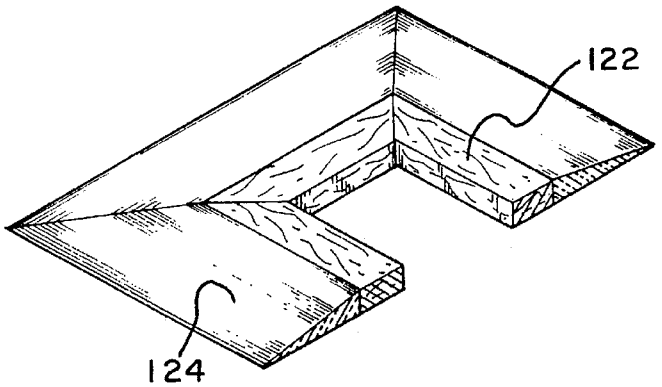
FIG. 5 is a cross-sectional view taken along lines 5—5 of FIG. 4.
Figure 4:
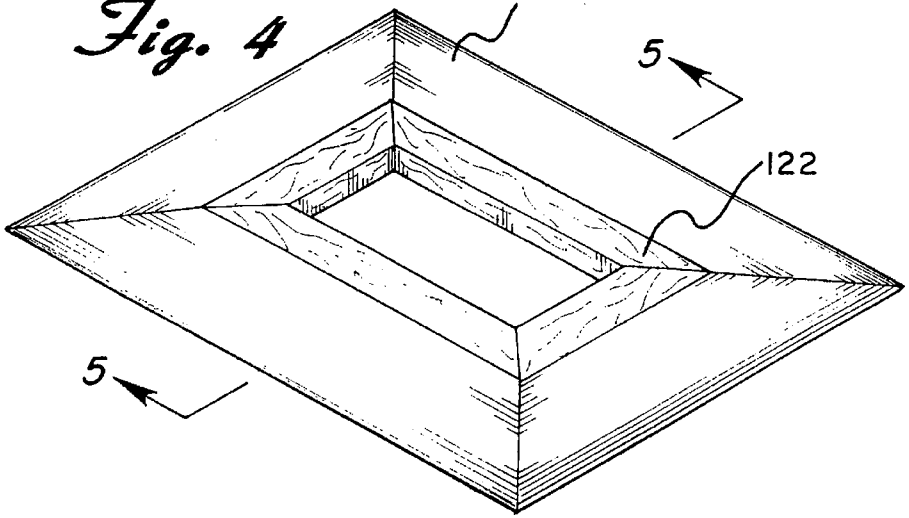
FIG. 4 is a perspective view of a rectangularly shaped raised member with tapered insulation secured around the outer periphery thereof.

An upper raised member 122 is secured on top of the lower raised member 118, preferably by nailing the same thereto. It should be noted that one raised member could be utilized instead of separate and distinct upper and lower raised members. Sections of tapered insulation 124 are positioned around the outer perimeter of the upper raised member 122 and on top of the insulation layer 120 (FIGS. 4 and 5).

Flashing 126 is secured to and extends upwardly from the upper raised member 122. In the preferred embodiment, the inside perimeter of the flashing is preferably slightly larger than the outside perimeter of the HVAC unit 116. The flashing is preferably comprised of aluminum. However, it can be comprised of a variety of other materials.

A panel 128 comprised of a waterproof flexible material is positioned over the HVAC unit 116, the upper raised member 122, the sections of tapered insulation 124, and the insulation layer 120 as best illustrated in FIG. 6. An X-shaped slit is preferably cut into the a portion of the panel to allow the HVAC unit to pass therethrough. The upper edge of the flashing 126 extends upwardly through the slit so that a substantially water tight seal is formed between the panel 128 and the flashing 126. The panel 128 is then secured to the flashing 126 using appropriate adhesives in a known manner. The preferred material for the panel 128 is silicone rubber. However, it can be composed of a variety of different waterproof materials. If standing water accumulates on the panel 128 during a rain storm, water is directed away from the seam between the flashing 126 and the panel 128 as a result of the raised member 122. Accordingly, the panel 128 and the roof structure 112 are protected against potential deterioration caused by the standing water.

Figure 3:
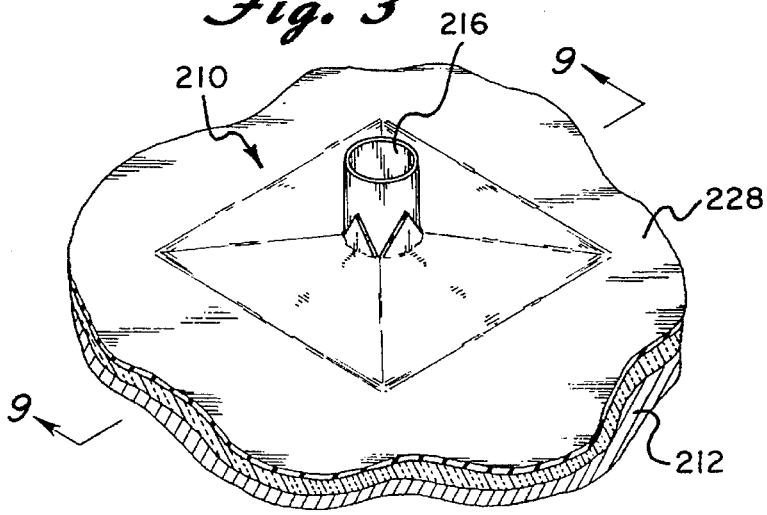
FIG. 3 is a perspective view of a rubber insulating layer shown covering a roof structure and located around a stand pipe.
Figure 9:
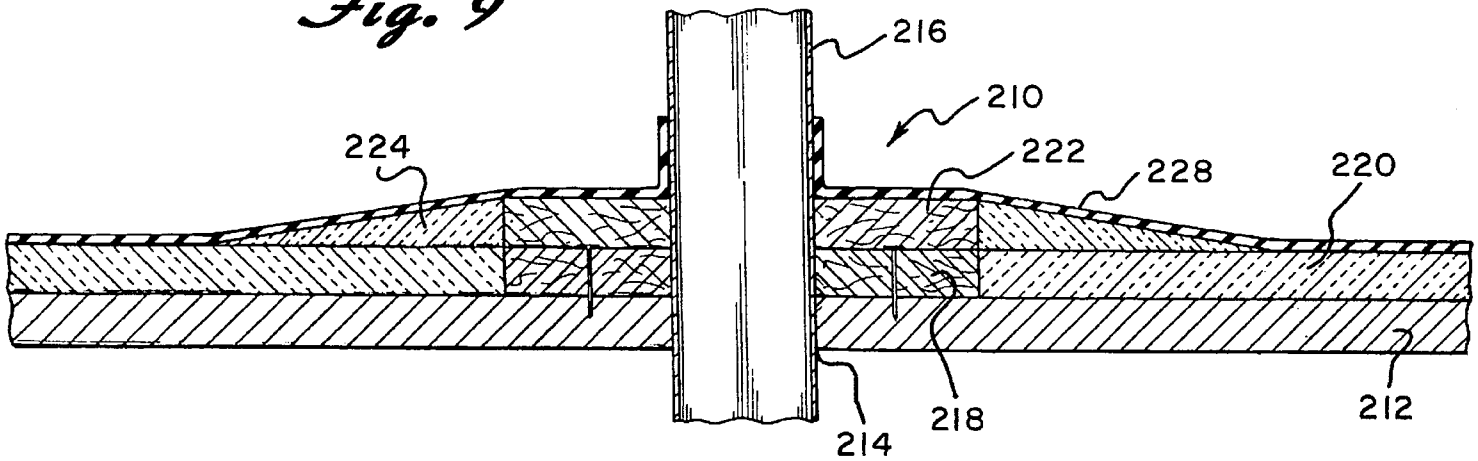
FIG. 9 is a cross-sectional view taken along lines 9—9 of FIG. 3.

Referring to FIGS. 3 and 9, yet another roofing system 210 is shown. Once again, the roofing system is adapted for use with a substantially flat roof structure 212. The roof structure 212 has an opening 214 formed therethrough in order to allow a stand pipe 216 or the like to pass (FIG. 9).

Positioned around the opening 214 is a lower raised member 218 which is preferably secured to the roof structure by nailing the same thereto (FIG. 6). A layer of insulation 220 is preferably placed around the outer perimeter of the lower raised member. An upper raised member 222 is nailed to the lower raised member 218. A section of tapered insulation 224 is positioned around the outer perimeter of the upper raised member 222 and on top of the insulation layer 220.

A panel 228 comprised of a waterproof flexible material is positioned over the stand pipe 216, the upper raised member 222, the sections of tapered insulation 224, and the insulation layer 220. The panel preferably has an opening formed therethrough which has an inside diameter which is slightly smaller than the outside diameter of the stand pipe. The preferred material for the panel 226 is silicone rubber. However, it can be composed of a variety of different waterproof flexible materials. Since the panel 228 is comprised of a flexible material, the area around opening in the panel can stretch to allow the stand pipe 216 to pass. However, since the panel material is resilient, a substantially water tight seal is formed between the panel 228 and the stand pipe 216. An adhesive or the like further seals and secures them together. Because of the raised members 218 and 222, no standing water accumulates on the roofing system 210, and water is directed away from the opening 214 in the panel 228 and the stand pipe 216.

The present invention may be embodied in other specific forms without departing from the spirit or essential attributes thereof and accordingly reference should be made to the appended claims rather than to the foregoing specification as indicating the scope of the invention.

What is claimed is:

1. A roofing system comprising:

a substantially flat roof structure;

at least one elongated member extending upwardly from said roof structure, said elongated member having two opposing ends, first and second planar side surfaces, a bottom surface and an upper surface, said first planar side surface being higher than said second planar side surface, said upper surface slanting downwardly form said first planar side surface to said second planar side surface;

first and second flexible panels being comprised of a waterproof material, each of said flexible panels having a side edge, said first flexible panel being positioned adjacent said first planar side surface, said second flexible panel being positioned adjacent said second planar side surface and in at least partial contact with said upper surface of said elongated member, said side edge of said first flexible panel overlying said second flexible panel and being positioned adjacent said second planar side surface of said elongated member, and means for securing said first and second flexible panels to said upper surface of said elongated member.

2. The roofing system of claim 1 wherein said securing means includes a plurality of nails inserted through each of said panels and into said elongated member.

3. The roofing system of claim 1 wherein said waterproof flexible material is comprised of rubber.

4. The roofing system of claim 1 further including a cap means secured over said upper surface of said elongated member.

5. The roofing system of claim 4 wherein said cap means comprises an elongated sheet of aluminum.

* * * * *